United States Patent [19]

Wadsworth

[11] 4,226,068

[45] Oct. 7, 1980

[54] APPEARANCE SYSTEM

[75] Inventor: Walter J. Wadsworth, Buzzards Bay, Mass.

[73] Assignee: Fern Engineering, Bourne, Mass.

[21] Appl. No.: 966,001

[22] Filed: Dec. 4, 1978

[51] Int. Cl.[2] ..... E04C 1/40; E04B 1/38

[52] U.S. Cl. ..... 52/508; 52/511; 403/6; 403/379

[58] Field of Search ..... 52/508, 511, 512, 513, 52/506, 701; 403/6, 379, 378

[56] References Cited

U.S. PATENT DOCUMENTS

| | | | |
|---|---|---|---|
| 82,664 | 9/1868 | Walters | 52/728 |
| 1,868,253 | 7/1932 | Rackebrandt | 52/508 |
| 3,012,639 | 12/1961 | Pavlecka | 52/511 |
| 3,019,864 | 2/1962 | Lester | 52/508 |
| 3,103,708 | 9/1963 | Pomeroy | 52/311 |
| 3,210,896 | 10/1965 | Detman | 52/508 |
| 3,476,912 | 11/1969 | Garrison | 52/513 |
| 3,545,153 | 12/1970 | Bach | 52/508 |
| 3,613,221 | 10/1971 | Pronk | 403/379 |
| 3,715,850 | 2/1973 | Chambers | 52/701 |

FOREIGN PATENT DOCUMENTS

| | | | |
|---|---|---|---|
| 667082 | 11/1938 | Fed. Rep. of Germany | 403/379 |
| 2701970 | 7/1978 | Fed. Rep. of Germany | 52/506 |
| 789416 | 8/1935 | France | 52/513 |
| 721129 | 12/1954 | United Kingdom | 52/513 |
| 1015688 | 1/1966 | United Kingdom | 52/508 |

*Primary Examiner*—Price C. Faw, Jr.
*Assistant Examiner*—Henry E. Raduazo
*Attorney, Agent, or Firm*—Norman S. Blodgett; Gerry A. Blodgett

[57] ABSTRACT

System consisting of a series of decorative panels arranged in coplanar relationship over the vertical surface of a structure, each panel being attached to the structure at its central point by a single separable connection.

5 Claims, 4 Drawing Figures

APPEARANCE SYSTEM

BACKGROUND OF THE INVENTION

The heating systems employed in many industrial applications generate large quantities of hot combustion products, that for health and safety reasons, must be removed from areas occupied by the public. The removal of hot gases produced by combustion is accomplished generally by use of vertical stacks that discharge the gases into the upper atmosphere. Maintaining an attractive finish on the outer surface of such stacks is extremely difficult, mainly because ornamental coverings, such as paint, applied directly to the surface tends to deteriorate rapidly and to break up. Such surface deterioration is due to thermal expansion and contraction of the stack due to the intermittent passage of gases therethrough and to variations in the flow of air over its surface due to wind changes and to change in radiation from night to day and the light. Furthermore, the corrosive nature of the combustion gases causes chemical attack on surfaces adjacent the stack. Consequently, an industrial stack usually exhibits an unattractive appearance that undesirably dominates the overall appearance of the industrial complex of which they form a part. In addition, it is difficult to maintain such finishes and, particularly, to repair localized damage. These problems arise in the case of gas turbine stacks, and the gas stacks of steam generating units, as well as the walls of boilers. In the latter case, there is also the problem that the boiler wall is usually covered with insulation and lagging which has a tendency to split, peel, and warp to a resulting unattractive appearance. These and other difficulties experienced with the prior art have been obviated in a novel manner by the present invention.

It is, therefore, an outstanding object of the invention to provide an appearance system providing a simple and long lasting means for beautifying the exterior surfaces of a stack used to confine the movement of industrially-produced combustion products.

Another object of this invention is the provision of an appearance system in which a plurality of decorative panels are applied to an industrial structure in such a way that movement of the structure due to thermal expansion and contraction does not destroy the attractiveness of the panels.

A further object of the present invention is the provision of a decorative panel system which is simple in construction, which is inexpensive to manufacture and apply, and which is capable of a long life of useful service with a minimum of maintenance.

It is another object of the instant invention to provide an appearance system in which a series of decorative panels are applied to a vertical surface in such a way that warping of the surface does not cause shifting of the panels in such a way as to give a change in appearance to the casual observer.

A still further object of the invention is the provision of an appearance system for applying decoration to a vertical surface in such a way that its appearance does not change appreciably despite major changes in the geometry of the surface.

With these and other objects in view, as will be apparent to those skilled in the art, the invention resides in the combination of parts set forth in the specification and covered by the claims appended hereto.

SUMMARY OF THE INVENTION

In general, the invention consists of an appearance system for use with an outdoor structure having a vertical surface. A plurality of flat panels are provided, each panel having an outer decorative surface facing outwardly of the vertical surface of the structure and having an inner surface lying in spaced, parallel relationship to the surface of the structure. The outer surfaces of the panels lie in the same general plane; adjacent edges of adjacent panels are located a substantial distance apart. An elongated primary support element is fixed to and extends at a right angle to the center of the inner surface of each panel. An elongated secondary support element is fixed to the vertical surface of the structure and extends at a right angle thereto. The primary and secondary support elements have conjugate surfaces to lock them together and a fastener is provided to assure against unintended separation.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
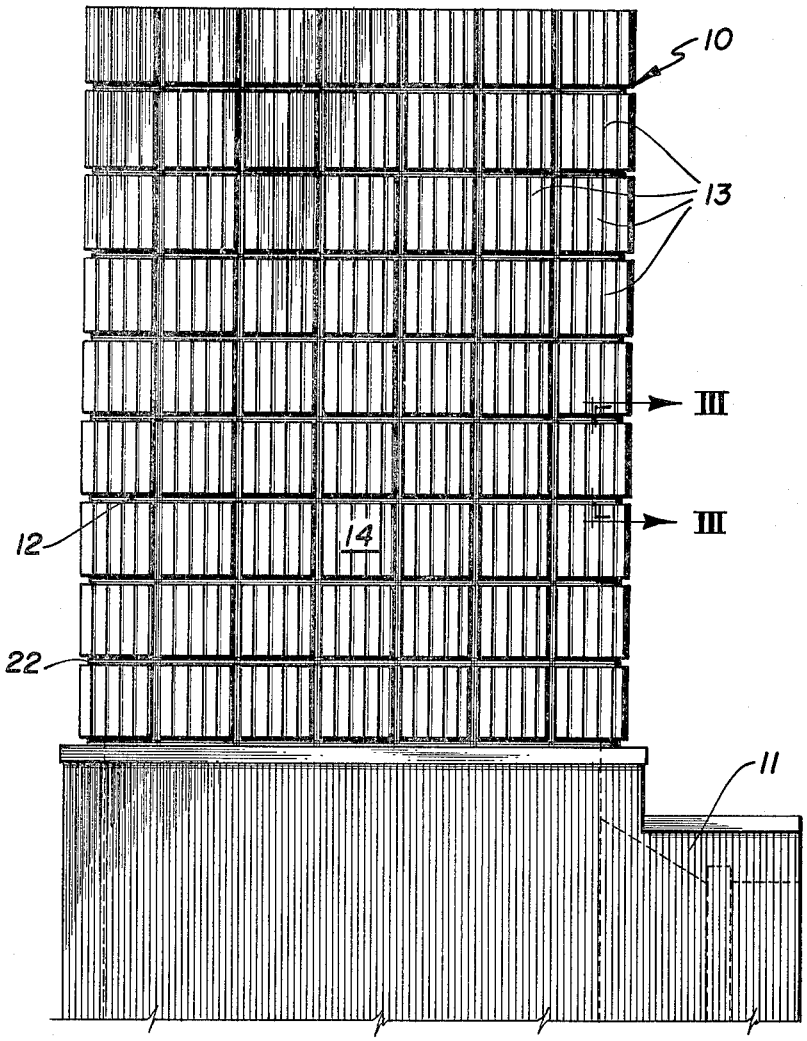
FIG. 1 is a front elevational view of an appearance system incorporating the principles of the present invention shown in use with a gas turbine exhaust system.

Referring first to FIG. 1, wherein are best shown the general features of the invention, the appearance system, indicated generally by the reference numeral 10, is shown in use with a structure 11 having a vertical surface 12 with which the system is associated. For the purpose of illustration, the structure is shown as being the exhaust tower of a gas turbine, but it will be understood that it could be the gas stack of a steam generating unit, or the heated wall of a boiler. The system is shown as consisting of a plurality of panels 13, each of which has a decorated outer surface 14. The adjacent edges of adjacent panels are separated by a substantial space 22.

Figure 3:
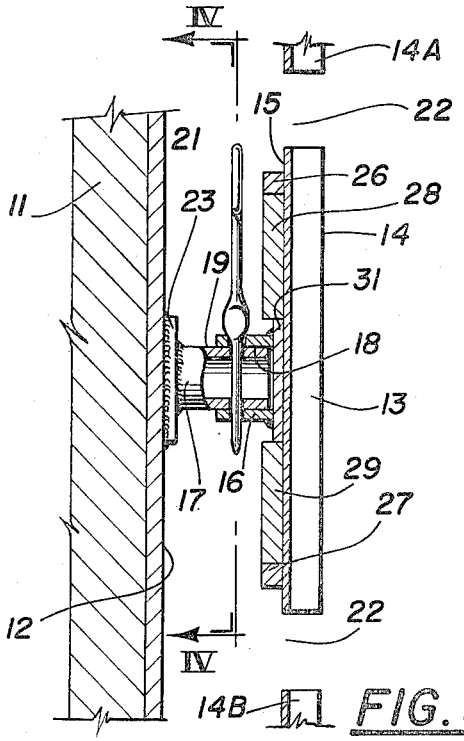
FIG. 3 is a vertical sectional view of the panel, taken on the line III—III of FIG. 1.
Figure 2:
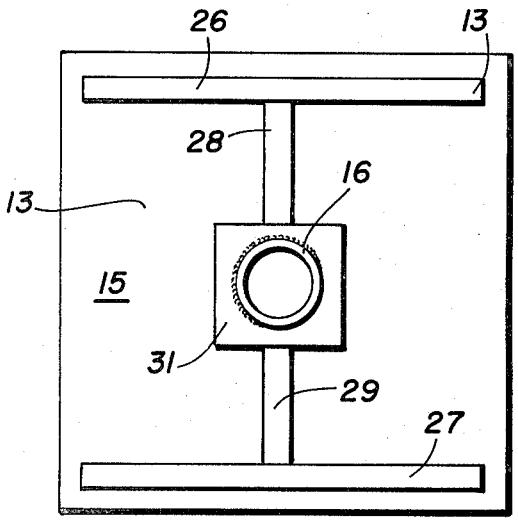
FIG. 2 is a rear elevational view of a panel forming part of the system.

In FIGS. 2 and 3, it can be seen that each panel 13 is provided with a rear surface 15 which faces toward, extends parallel to, and is substantially spaced from the surface 12 of the structure. An elongated primary support element 16 extends from the center of the rear surface of each panel 13. An elongated secondary support element 17 is fixed to the surface 12 of the structure and extends at a right angle thereto. The primary and secondary support elements 16 and 17 are provided with conjugate surfaces 18 and 19, respectively, to lock them rigidly together. The fastener 21 extends through the support elements 16 and 17 to prevent unintended separation.

The space 22 between the adjacent edges of adjacent panels 13 is sufficient to permit human access, particularly to allow the arm of a mechanic to reach to the rear of each panel and to the fastener 21. The secondary support 17 is provided with a base 23 which is welded to the vertical surface 12 of the structure 11. Conjugate surfaces 18 and 19 consist of an external cylindrical surface 19 on the support element 17 and an internal cylindrical surface 18 on the support element 16.

Figure 4:
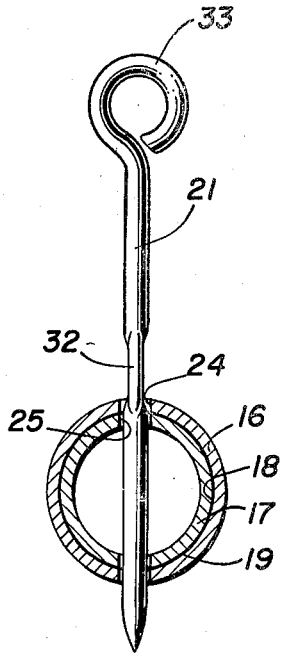
FIG. 4 is a vertical sectional view of a panel taken on the line IV—IV of FIG. 3.

FIG. 4 shows particularly well the manner in which the pin 21 extends through an aperture 24 on the support element 16 and an aperture 25 on the support element 17. A stop 32 is provided along the shank of the pin 21 and a grasping ring 33 is provided at its upper end.

Referring again to FIG. 2, it can be seen that the rear surface 15 of the panel 13 is provided with an upper horizontal stiffening rib 26 and a lower horizontal stiffening rib 27. The support element 16 is attached to a base 31 and a vertical rib 28 extends from the horizontal rib 26 to the base 31, while a similar vertical rib 29 extends from the rib 27 upwardly to the base 31.

The operation and advantages of the present invention will now be readily understood in view of the above description. In applying the panels 13 to the surface 12 of the structure 11, the normal practice would be to apply the series of secondary support elements 17 to the surface 18 by welding each base 31 to that surface by use of a bead weld. Presumably, the locations of the elements 17 are selected to be spread evenly over the entire surface to give proper spacing of the panels when they are eventually applied. In any case, once the elements 17 have been welded in place, the panels are then applied by inserting the tubular secondary support 17. Once they have been slid together, the pin 21 is dropped in place and serves to prevent the panel 13 from rotating from its proper vertical-horizontal position on the surface. The location of the apertures 24 and 25 in the support elements 16 and 17, respectively, not only assures that the panels are located properly over the surface, but also that they are horizontally spaced away from the surface 12 in the same amount, that is to say, so that the outer surfaces 14 of all of the panels 13 lie in a common vertical plane. When the panels are arranged in this way, the appearance of the structure is very pleasing, since, irrespective of the condition of the surface 12 of the structure, the outer surfaces 14 of the panels lie in the same plane in a pattern and can be maintained in a decorative condition. For instance if (over a period of time) one of the panels 13 becomes damaged or discolored, due to chemical deterioration from the stack, it can be replaced without the necessity of disturbing the remainder of the panels in the array. The maintenance person simply puts his hand through the space 22 at the top edge of the panel and reaches downwardly to grasp the pin 21. Pulling upwardly on the pin and removing it from the support elements 16 and 17, allows the panel to be slid outwardly. A new panel then can be moved into place and the pin replaced. If the surface 12 of the structure warps and twists, it would normally present a very undesirable condition. With the panels 13 in place a slight change in angularity of the secondary support element 17 relative to the vertical will cause a similar angular change in the panel 13. However, because the panels are suitably spaced apart, this change in angularity will not be obvious to the naked eye, particularly if the decorative pattern on the outside of the panel is suitably selected.

It can by seen, then, that, by use of the present appearance system, the visual impact on the casual observer will be one of neatness and cleanliness, which will result in a pleasant impression to persons in the neighborhood. This removes some of the feeling of antagonism that sometimes exists in the vicinity of an industrial operation. Furthermore, by use of the present system, the pleasing appearance can be maintained over a long period of time without difficulty, despite deterioration of the outer surface of the structure. In other words, the present application discloses an aesthetically-improved stack structure for confining the movement of combustion products. Concealing the stack is the array of panels, each overlying a different area of its exterior surface. The panels are supported from the stack by supports that allow universal relative movement between the panels and serves to accommodate (in any area of the stack) relative movement between spaced apart regions, which movement is not experienced by corresponding regions in an overlying panel. Because of the relative movement permitted by the support members between both the individual panels and the underlying surface of the stack itself, the periodic expansion and contraction of the stack caused by temperature variations do not degrade the appearance of the panel array. The panel array is spaced from the exterior surface of the stack so as to create a heat-transfer barrier therebetween and each panel is supported by a single support member that is attached only to the exterior surface of the stack. The individual panels are spaced apart, thus permitting relative movement therebetween, and the single support member accommodates relative movement between different regions on any area of the stack covered by a given panel.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Appearance system for use with an outdoor structure having a vertical surface, comprising:

(a) a plurality of flat panels, each having a decorative outer surface facing outwardly of the said vertical surface and having an inner surface lying in spaced, parallel relationship to the said vertical surface, the outer surfaces of the panels lying in the same general plane with adjacent edges of adjacent panels having a substantial space between them, the said space between the adjacent edges of adjacent panels being sufficient to permit human access to the rear of each panel and to the fastener, (b) an elongated primary support element fixed to and extending at a right angle to the center of the inner surface of each panel, (c) an elongated secondary support element fixed to the said vertical surface and extending horizontally therefrom, the primary and secondary support elements having conjugate surfaces to lock them rigidly together, the secondary support being provided with a base which is welded to the vertical surface of the structure, the conjugate surfaces consisting of an external cylindrical surface on one of the support elements and an internal cylindrical surface on the other support element, and (d) a fastener joining the support elements to prevent unintended separation, the fastener consists of a pin extending vertically through matching apertures in the support element.

2. Appearance system for use with an outdoor structure having a vertical surface, comprising:

(a) a plurality of flat panels, each having a decorative outer surface facing outwardly of the said vertical surface and having an inner surface lying in spaced, parallel relationship to the said vertical surface, the outer surfaces of the panels lying in the same general plane with adjacent edges of adjacent panels having a substantial space between them, (b) an elongated primary support element fixed to and extending at a right angle to the center of the inner surface of each panel and having an external cylindrical surface, (c) an elongated secondary support element fixed to said vertical surface and extending horizontally therefrom, the primary and secondary support elements having conjugate surfaces consisting of an external cylindrical surface on one of the support elements and an internal cylindrical surface on the other support element, and (d) fastening means joining the support elements to prevent unintended separation, said fastening means consisting of a pin extending through matching apertures in the primary and secondary support elements.

3. Appearance system as recited in claim 2, wherein the said space between the adjacent edges of adjacent panels is sufficient to permit human access to the rear of each panel and to the fastener.

4. Appearance system as recited in claim 3, wherein the secondary support is provided with a base which is welded to the vertical surface of the structure.

5. Appearance system for use with an outdoor structure having a vertical surface, comprising:

(a) a plurality of flat panels, each having a decorative outer surface facing outwardly of the said vertical surface and having an inner surface lying in spaced, parallel relationship to the said vertical surface, the outer surfaces of the panels lying in the same general plane with adjacent edges of adjacent panels having a substantial space between them, (b) an elongated primary support element fixed to and extending at a right angle to the center of the inner surface of each panel, (c) an elongated secondary support element fixed to said vertical surface and extending horizontally therefrom, one of said primary and secondary elements being tubular and having an open end for receiving the other of said support elements in a close sliding fit, and (d) fastening means joining the support elements to prevent unintended separation of said support elements, said fastening means consisting of a pin extending through matching apertures in the primary and secondary support elements.

* * * * *